United States Patent [19]

Brown

[11] 4,211,417

[45] Jul. 8, 1980

[54] PRACTICE PUTTING GREEN

[76] Inventor: Glen Brown, 1316 Brook La., Rochester, Mich. 48063

[21] Appl. No.: 935,162

[22] Filed: Aug. 21, 1978

[51] Int. Cl.[2] ..... A63B 69/36

[52] U.S. Cl. ..... 273/176 H; 273/178 B

[58] Field of Search ..... 273/176 H, 195 B, 32 C, 273/188 A, 176 F, 176 FA, 176 FB, 176 G, 176 J, 176 L, 109, 178 B

[56] References Cited

U.S. PATENT DOCUMENTS

| | | | |
|---|---|---|---|
| 1,612,291 | 12/1926 | Jackson | 273/176 H |
| 1,662,864 | 3/1928 | Petersen | 273/176 H |
| 1,761,039 | 6/1930 | Hazeltine | 273/176 H |
| 2,678,823 | 5/1954 | Hugman | 273/176 H X |
| 3,170,694 | 2/1965 | Dolce | 273/176 H |
| 3,522,947 | 8/1970 | Anderson et al. | 273/176 H |
| 3,658,343 | 4/1972 | Rogers et al. | 273/176 H |
| 3,727,917 | 4/1973 | MacLean | 273/176 H |
| 3,870,301 | 3/1975 | Brisendine | 273/176 H X |

FOREIGN PATENT DOCUMENTS

| | | | |
|---|---|---|---|
| 2055218 | 5/1972 | Fed. Rep. of Germany | 273/176 H |

*Primary Examiner*—George J. Marlo

*Attorney, Agent, or Firm*—Fisher, Gerhardt, Crampton & Groh

[57] ABSTRACT

A practice putting green which is contourable relative to a reference surface to more closely approximate the actual surface of a putting green. The supporting surface, located beneath a resilient green-like covering, is divided up into plurality of planar sections fastened together by pieces of band steel attached to the undersides of the planar members, and spanning their abutting edges so as to allow the sections to move moderately relative to one another in a vertical direction. This surface in turn is supported by the reference surface and remote control elements are provided so that a wedge under the planar members may be moved in order to contour and decontour the surface.

6 Claims, 6 Drawing Figures

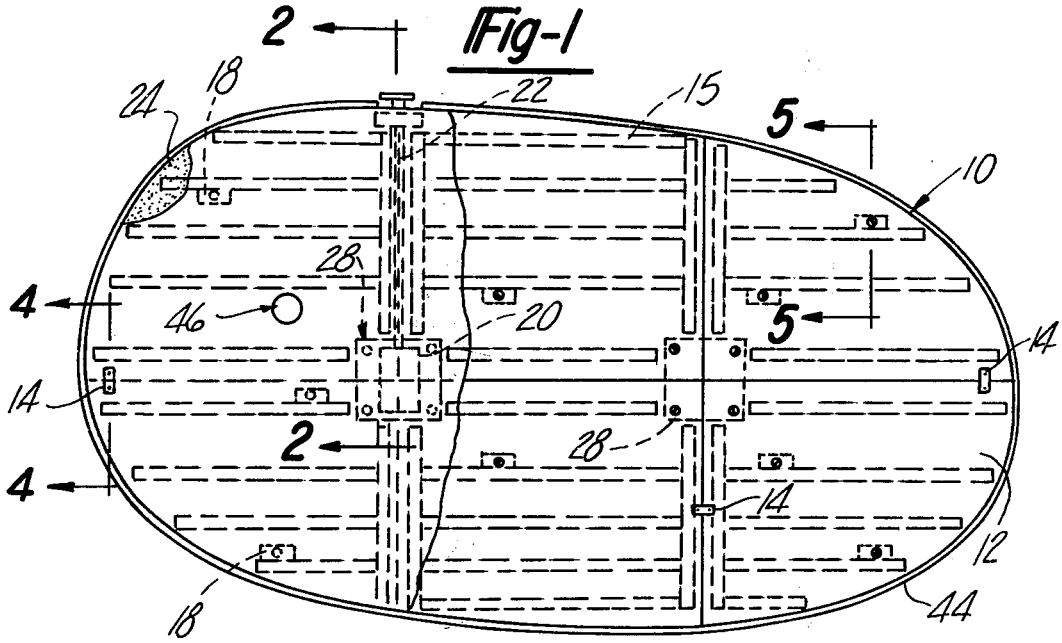
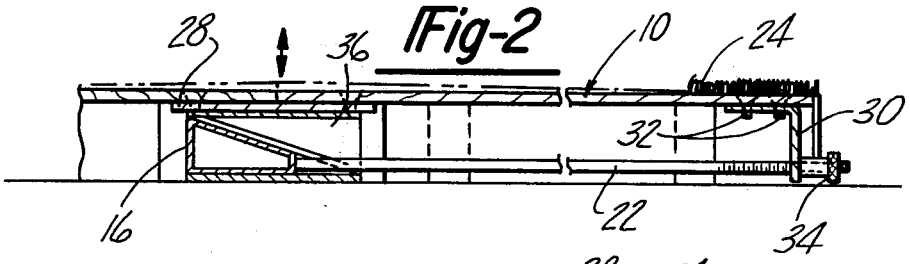
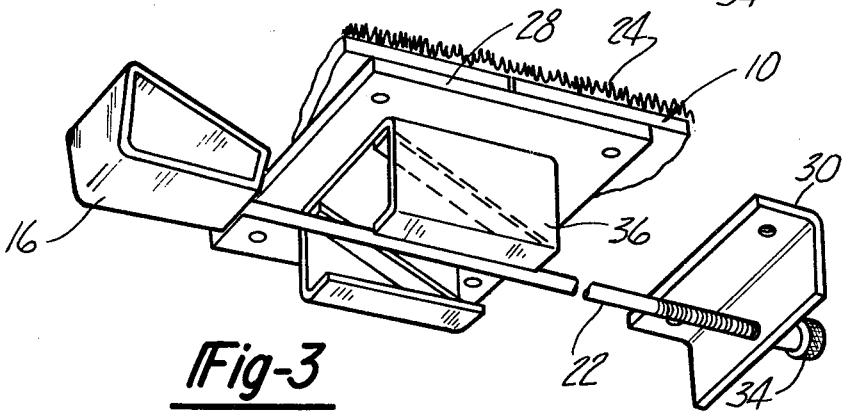
Fig-3

PRACTICE PUTTING GREEN

This invention relates to a practice putting green, the surface of which may have its countour changed relative to a reference surface in order to simulate the breaks and rolls actually found in putting greens.

Past solutions to this need include greens with contours built in and not movable or have provided surfaces which are so pliable that they do not easily support the weight of a golfer, or include surfaces which, while rigid enough to support the weight of a golfer, require a great deal of force in order to change the contour.

It is an object of this invention to provide a practice putting green with a playing surface sufficiently rigid to support the weight of a golfer, but with sufficient flexibility to allow for easy change in the contour of the surface.

Another object of the invention is to provide a playing surface made up of sections joined together so as to be moderately movable relative to one another in a vertical direction, but held together to provide continuity in a horizontal direction such that any sharpness of break along contour lines may be easily smoothed over with a resilient covering.

Another object of the invention is to provide a putting surface which may be easily contoured by a player from a position outside the surface of the green.

Still another object of the invention is to provide a putting green made up of standardized sections so that various size greens can be easily built up out of the standard sections.

The objects of this invention are accomplished by building the playing surface out of a plurality of smaller, discrete planar sections, joined together in adjacent contacting relationship. Each planar section is supported above a reference surface such as a floor or the ground and is sufficiently rigid to support the weight of a golfer.

The individual sections are joined together by fastening members which hold the sections together to prevent them from moving significantly relative to one another in the horizontal direction, but which are sufficiently flexible to allow for easy moderate movement of the sections relative to one another in the vertical direction. The planar sections, which are stiff enough or rigid enough to support the weight of a golfer, together form a surface which is easily contourable. The fastening members also serve to maintain the sections in a relatively continuous surface, such that any breaks created along lines of contour may be easily smoothed out with a simple resilient covering.

A movable lifting means, consisting in this case of a slidable wedge, is provided for lifting or lowering any desired section of the playing surface relative to the rigid reference surface. A means is provided for moving the lifting means which is controllable from a position outside the surface of the putting green.

In addition, a movable means is provided for maintaining contact between the rigid support surface or reference surface and the playing surface when a section of it is moved moderately upward as a part of the contouring process.

These and other objects of invention will become apparent from the following description and from the drawings in which FIG. 1 is a top view of the putting green embodying the invention;

FIG. 2 is a cross sectional view of the putting green taken along line 2—2 in FIG. 1;

FIG. 3 is a perspective view of the movable lifting means or mechanism and a portion of the putting green viewed from a position beneath the putting green;

Figure 4:
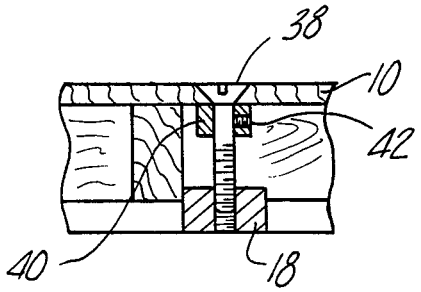
FIG. 4 is a cross sectional view taken along line 4—4 in FIG. 1.
Figure 5:
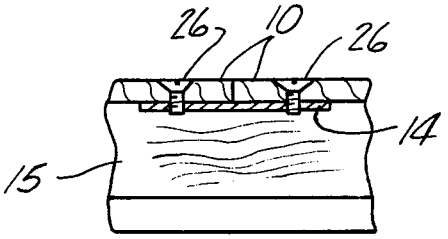
FIG. 5 is a cross sectional view taken along 5—5 of FIG. 1.
Figure 6:
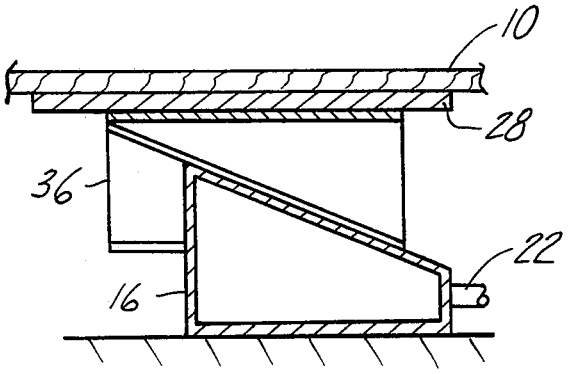
FIG. 6 is a view on a slightly enlarged scale of the lift mechanism seen in FIG. 2, showing it as it would appear with the putting green in the up or contoured position.

A putting green embodying the invention is designated generally at 10, being made up of a plurality of smaller discrete planar members, which are designated generally at 12. Fastening members 14 are attached to the underside of the planar members 12 at a plurality of points along boundaries of adjacency. Supports or runners designated at 15 are attached to the underside of planar members 12 and serve to support the planar members above the rigid reference surface. Movable support blocks designated generally at 18 are located at a plurality of desired locations beneath the reference surface and are maintained in a contacting relationship between the underside of planar members 12 and the rigid reference surface when the playing surface is lifted. A lifting means designated generally at 20 is located at a point in the interior of the playing surface and between the rigid reference surface and the underside of the planar members 12. A resilient overlayment 24, covers the entire surface area at 10.

The planar members 12 are made of material with sufficient rigidity to support the weight of a player, such as 5/8" plywood, three-quarter-inch particle board or quarter-inch structural foam. Many other materials, of course, will provide sufficient rigidity. Each planar member 12 also has standard inner dimensions which allows various size greens to be built up out of standard sections. The outer surface of the planar members 12 is curved as desired to simulate the actual border of a putting green. Each planar member 12 is supported above the reference surface by a plurality of runners, designated generally at 15, which in the present embodiment are 1"×2" lumber. The height of the runners 15 is determined by the amount of space necessary between the rigid reference surface and the underside of the planar members 12 to contain the lifting means 20. The overlayment, 24, which covers the entire planing surface is made up of an artifical grass such as "ASTRO TURF" or any other material which is flexible and resilient and which approximates the surface of the actual putting green.

The fastening members 14 are attached to the underside of the planar members 12 along boundaries of adjacency at desired locations. In the present embodiment, they are located approximately every four feet along said boundaries. The property necessary for these fastening members is that they be sufficiently rigid to prevent the planar members 12 from moving significantly relatively to one another in a horizontal direction, but be of sufficient flexibility to allow for easy relative movement of the planar members 12 in the vertical direction. Experimentation has shown that pieces of band steel approximately 1" by 3" by ¼" attached to the underside of the planar members 12 with screws have the desired properties.

This requirement can be theoretically restated as a requirement that the modulus of elasticity of the fastening members in the direction parallel to the surface 10 be greater than or equal to the equivalent modulus of elasticity of the planar members 12, and that the coefficient of rigidity of the fastening members be less than the planar members 12. Thus, the planar members 12 will be maintained in a horizontal contacting relationship, but shear stresses applied to the surface 10 will be concentrated at the boundaries between planar members 12, thus providing the desired contouring without bending the entire surface 10.

Also serving to maintain planar members 12 in the desired relationship are steel plates 28 which are located at each intersection of boundaries of adjacency of the planar members 12. In the present embodiment the plates are ½" steel approximately 6"×6" and as well as serving to join the planar members 12 together, they serve as bearing plates for the lift mechanism 20, as will be discussed later.

The lifting means or mechanism consists of a rigid wedge 16 formed of steel or similar material. The rigid wedge 16 is attached to rod 22, which rod is threaded and held in place by a bracket 30. Bracket 30 is attached to the underside of the playing surface 10 by screws 32 which screws are counter sunk in the playing surface. Attached to the end of a rod 22 is crank 34.

Attached to the underside of plate 28 is ramp 36, which is again formed of steel or some rigid material. Ramp 36 rests against the reference surface when the putting green is in the uncountered position, but when crank 34 is turned, rod 22 draws wedge 16 up against ramp 36, thus lifting the underside of the putting green. The process is simply reversed when the crank is turned in the opposite direction.

In the present embodiment, the weight of the planer sections 12 with their attached runners 15 is sufficient that when the wedge mechanism 16 is drawn up against the underside of the putting green lifting it in its interior, the outer margin of the putting green remains against the reference surface. This serves to provide a constant support surface for the putting green along its exterior. The rigid wedge 16 drawn against the plate 28 acts in effect as a fulcrum around which the force of gravity acts, providing shearing force on the fastening members 14 along the boundaries of adjacency, thus acting to contour the surface.

When the putting green is in the contoured position, it will be obvious that runners 15 located interiorly of the exterior margin will be lifted above the reference surface. This is compensated for by the presence of movable support blocks designated generally at 18. These are located in as many positions as may be desired, the determining factor being the size of the putting green and the amount of support that is desired. In the present embodiment, the support blocks are located approximately every five feet, and are located approximately two feet from the outer margin of the putting surface. This allows easy access to the support block 18, as the overlayment 24 must be lifted in order to move them up or down. As seen in FIG. 4, each support block consists of steel block 18 into which is threaded a screw or bolt 38. The head of the bolt 38 is counter sunk into the playing surface 10 as shown and is prevented from passing through the playing surface 10 by the addition of collar 40 which is attached by set screw 42 to the bolt. The movable support blocks 18 are located proximate to a runner 15 such that they will not turn when the bolt 38 is turned. The steel block 18 will be drawn up or down as the case may be and provide a movable constant support between the underside of the playing surface 10 and the rigid reference surface.

A skirt or border 44 is attached around the margin of the playing surface 10 to simply mask the underside of the playing surface 10 from view. Standard size holes or cups for the reception of golf balls are provided at desired locations.

The embodiments of the invention in which an exclusive property or privilege is claimed are defined as follows:

1. A putting green which is contourable relative to a reference surface, comprising a playing surface composed of a plurality of planar members of sufficient rigidity to support the weight of a player, means supporting said playing surface above the reference surface, said planar members being disposed in adjacent contacting relationship, connecting elements joining said planar members together along the boundaries of said planar members, said connecting elements having a coefficient of elasticity in the direction tangential to said planar members sufficient to resist relative horizontal movement of said planar members, said connecting elements also having a coefficient of rigidity which is substantially constant in the area where said boundaries between said planar members intersect, said coefficient of rigidity of said connecting elements being of a value such that the effective coefficient of rigidity of said playing surface along said boundaries between adjacent planar members is less than the coefficient of rigidity of said adjacent planar members, a resilient covering on said planar members to form a continuous playing surface, and means to movably and forcibly deflect said planar members at selected locations thereon, said deflecting means acting to deflect said playing surface at said boundaries a greater amount than the planar members adjacent thereto to vary the contour of said playing surface.

2. A practice putting green as described in claim 1, wherein said deflecting means comprises a rigid mechanism disposed between the reference surface and the underside of said planar members at selected locations thereon, said rigid mechanism being variable in height to deflect said planar members in a direction substantially perpendicular to the force of gravity on said playing surface and thereby creating a shearing force at said boundaries.

3. A practice putting green as described in claim 2, wherein said rigid mechanism disposed between the reference surface and the underside of said planar members further includes means for remotely controlling the change in height thereof from a location outside the margin of said playing surface.

4. A practice putting green as described in claim 2, wherein said rigid mechanism disposed between the reference surface and the underside of said planar members is located interiorally of the outer margin of said planar members forming said playing surface, and wherein the weight of said planar members comprising said playing surface is such that the outer margin of said playing surface remains disposed against the reference surface when said rigid mechanism deflects the planar members.

5. A practice putting green as described in claim 2, wherein said rigid mechanism disposed between said reference surface and the underside of said planar members, comprises a wedge, and further includes an incline attached to the underside of said planar members at a selected location thereon, said wedge being slidably movable between the reference surface and said incline to deflect said planar members.

6. The practice putting green as described in claim 1, wherein said means supporting the playing surface comprises a plurality of load bearing members attached to the underside of said planar members and resting on said reference surface, and further includes means for maintaining said load bearing members in contact with said reference surface when the planar members are deflected.

* * * * *